US011953273B2

(12) United States Patent
Han et al.

(10) Patent No.: US 11,953,273 B2
(45) Date of Patent: Apr. 9, 2024

(54) HEAT DISSIPATING DEVICE USING TURBULENT FLOW

(71) Applicant: HYOSUNG HEAVY INDUSTRIES CORPORATION, Seoul (KR)

(72) Inventors: Chang Woo Han, Goyang-si (KR); Young Joo Kim, Busan (KR); Kang Min Choi, Daejeon (KR); Seung Boong Jeong, Anyang-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 283 days.

(21) Appl. No.: 17/623,426

(22) PCT Filed: Jan. 28, 2021

(86) PCT No.: PCT/KR2021/001164
§ 371 (c)(1),
(2) Date: Dec. 28, 2021

(87) PCT Pub. No.: WO2021/177603
PCT Pub. Date: Sep. 10, 2021

(65) Prior Publication Data

US 2022/0349663 A1 Nov. 3, 2022

(30) Foreign Application Priority Data

Mar. 5, 2020 (KR) ..... 10-2020-0027636

(51) Int. Cl.
*F28F 13/12* (2006.01)
*F28F 9/02* (2006.01)
*F28F 9/24* (2006.01)

(52) U.S. Cl.
CPC ..... *F28F 13/12* (2013.01); *F28F 9/0219* (2013.01); *F28F 9/24* (2013.01)

(58) Field of Classification Search
CPC .. F28F 13/12; F28F 9/0219; F28F 9/24; F28F 2230/00; F28F 1/405; F28F 7/02;
(Continued)

(56) References Cited

U.S. PATENT DOCUMENTS

2007/0151713 A1 7/2007 Lee et al.

FOREIGN PATENT DOCUMENTS

CN 101749053 A * 6/2010 ..... F01D 5/187
JP 2002-130979 A 5/2002
(Continued)

*Primary Examiner* — Emmanuel E Duke
(74) *Attorney, Agent, or Firm* — NKL LAW; Jae Youn Kim

(57) ABSTRACT

Proposed is a heat dissipating device using turbulent flow. In the heat dissipating device, a plurality of block flow paths are formed in parallel inside a block body, a first cap and a second cap are mounted on side surfaces of the respective ends of the block body so as to connect the block flow paths, a working fluid flows into the block flow paths, and the working fluid which has passed through the block flow paths is transferred to the outside. Turbulence generators are mounted inside the block flow paths, and finishing end portions on the respective ends of the turbulence generators are supported by the first cap and the second cap and are positioned inside the block flow paths.

8 Claims, 4 Drawing Sheets

(58) Field of Classification Search
CPC ..... F28F 2220/00; F28F 3/022; F28F 3/06; F28D 2021/0029; F28D 2021/0031; F28D 1/0246; F28D 1/035; F28D 1/03; F28D 21/00
See application file for complete search history.

(56) References Cited

FOREIGN PATENT DOCUMENTS

| | | | | | |
|---|---|---|---|---|---|
| JP | 2015-224804 | A | | 12/2015 | |
| KR | 10-2001-0027876 | A | | 4/2001 | |
| KR | 10-2003-0086956 | A | | 11/2003 | |
| KR | 20060083487 | A | * | 7/2006 | ..... B21D 37/10 |

* cited by examiner

HEAT DISSIPATING DEVICE USING TURBULENT FLOW

TECHNICAL FIELD

The present disclosure relates to a heat dissipating device using turbulent flow and, more particularly, to a heat dissipating device using turbulent flow with turbulence generators installed inside flow paths through which a working fluid flows.

BACKGROUND ART

Much heat is generated in various electric and electronic devices during operation thereof, and if such heat is not properly discharged to the outside, the performance of the device is deteriorated and durability decreases, and excessive heat damages the device itself. In order to solve this problem, electric and electronic devices that generate heat during operation (hereinafter referred to as "heat source") dissipate heat in various ways.

For example, a fan is used to direct air to a heat source, or a heat sink is installed on the heat source, so that the heat transferred through the heat sink is transferred to cooling fins installed in the heat sink, and heat is transferred to the air to be discharged to the outside.

Also, a working fluid such as coolant is used to flow along block flow paths inside a block body corresponding to the heat sink, transfer heat, and flow out of the flow paths to dissipate heat to the outside.

In the case of a heat dissipation device using a working fluid, heat transfer can be enhanced or improved by allowing the working fluid to flow in turbulent flow. To this end, a turbulence generator in the form of a cylindrical coil spring is installed inside the block flow paths of the block body. Turbulence generators inside the block flow paths make the working fluid flowing inside the block flow paths turbulent, allowing better heat transfer to the working fluid.

However, there is no configuration that can firmly fix the turbulence generators in the block flow paths, and since the turbulence generators are not firmly fixed in certain positions in the block flow paths, the turbulent flow does not occur as designed and the shape of the turbulence generators are deformed. The reason that it is difficult to securely fix the turbulence generators in the block flow paths is because it is difficult to install a dedicated part for fixing the turbulence generator in the block flow paths.

Also, in a heat dissipation device using a block body with block flow paths formed therein, caps need to be installed at both ends of the block body to connect the flow paths so that a flowing path of the working fluid is made as long as possible within the block body. However, the problem is that a lot of flow loss occurs in connection flow paths formed in the caps at both ends of the block body.

In addition, when installing caps at both ends of the block body, O-rings are placed to prevent leakage of the working fluid, but since the O-rings positioned between the block body and the caps are not fixed at correct positions, it is problematic that the positions of the O-rings are changed in the process of coupling the caps to the block body.

DISCLOSURE

Technical Problem

Accordingly, the present disclosure is proposed to solve the above-described problems and an objective of the present disclosure is to provide a heat dissipating device using turbulent flow, with turbulence generators positioned correctly inside flow paths.

Another objective of the present disclosure is to provide a heat dissipating device using turbulent flow, with turbulence generators fixed firmly inside flow paths.

Still another objective of the present disclosure is to provide a heat dissipating device using turbulent flow, in which a plurality of flow paths through which a working fluid flows are formed side by side in a hexahedral block, and in connecting these flow paths with connection flow paths in caps, the flow loss in the connection flow paths is minimized.

Still another objective of the present disclosure is to provide a heat dissipating device using turbulent flow, in which seals are accurately and firmly positioned between the block body and the caps when the caps are mounted on the block body.

Technical Solution

According to an embodiment of the present disclosure for achieving the objectives as described above, provided is a heat dissipating device using turbulent flow, including: a block body in which a plurality of block flow paths through which a working fluid flows are formed side by side; a first cap coupled to a side surface formed at a first end of the block body, and in which a connection flow path connecting between the block flow paths is formed; a second cap coupled to a side surface formed at a second end of the block body, and in which connection flow path connecting between the block flow paths is formed; and a turbulence generator installed inside the block flow paths to make a flow of the working fluid turbulent, with finishing end portions formed at opposite ends thereof being supported by the first cap and the second cap.

The first cap and the second cap may be provided with inlet/outlet flow paths through which the working fluid enters and exits the block flow paths.

Hanging ends at which the finishing end portions of the turbulence generator are supported by the first cap and the second cap function as edge regions of the inlet/outlet flow paths and the connection flow path formed in the first cap, and of the inlet/outlet flow paths and the connection flow paths formed in the second cap.

The turbulence generator has a cylindrical coil spring shape and has an outer diameter smaller than an inner diameter of each of the block flow paths, and an outer diameter of each of the finishing end portions of the turbulence generator is formed to be larger than a diameter of a circular region in which the hanging ends are formed.

A number of turns of the cylindrical coil spring formed at each of the finishing end portions is more than two.

The inlet/outlet flow paths are connected to inlet/outlet connection pipes.

Each of the connection flow path formed in the first cap and the connection flow paths formed in the second cap has a curved inner surface.

A seal is positioned between the first cap and the side surface of the block body or the second cap and the side surface of the block body, a seal groove in which the seal is located is formed on either side of the first cap or the side surface of the block body, or on either side of the second cap or the side surface of the block body.

Advantageous Effects

In a heat dissipating device using turbulent flow according to the present disclosure, at least one or more of the following effects can be obtained.

In the heat dissipating device using turbulent flow according to the present disclosure, a first cap and a second cap are installed at both ends of the block body in which the block flow paths are formed, and the ends of the turbulence generators are supported in contact with the edges of the flow paths formed in the first cap and the second cap. Therefore, in the present disclosure, the ends of the turbulence generators are supported by the caps without any separate dedicated parts, and installation locations of the turbulence generators are accurately set, creating turbulent flow as designed and thereby increasing the heat dissipation efficiency.

In the heat dissipating device using turbulent flow according to the present disclosure, the inner surface of each of the connection flow paths formed in the caps to connect between the block flow paths is formed in a curved shape so that the flow direction of the working fluid can be changed smoothly. Accordingly, the flow loss can be minimized in the process in which the working fluid flows along the connection flow paths.

In the heat dissipating device using turbulent flow according to the present disclosure, a number of turns of the cylindrical coil spring formed at each of the finishing end portions is more than two times. Since both ends of the turbulence generator are made sturdy, deformation does not occur and when the ends of the turbulence generator are seated on the hanging ends formed in the cap, the shape of the turbulence generator is maintained and the turbulence generator is firmly supported.

MODE FOR INVENTION

Figure 1:
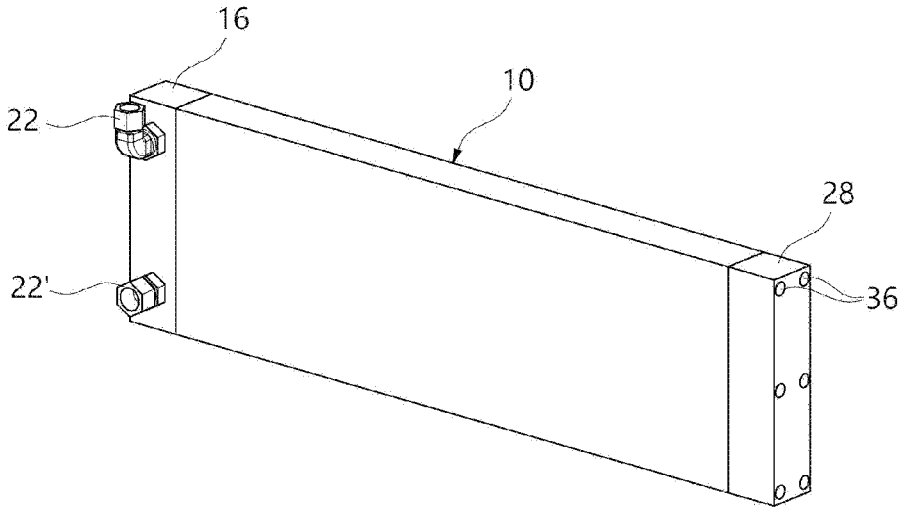
FIG. 1 is a perspective view showing the configuration of a preferred embodiment of a heat dissipating device using turbulent flow according to the present disclosure.

Hereinafter, some embodiments of the present disclosure will be described in detail with reference to the accompanying exemplary drawings. It should be noted that in assigning reference numerals to the components of each drawing, for the same components, even if they are indicated on different drawings, they are to have the same reference numerals as much as possible. Also, in describing an embodiment of the present disclosure, when it is determined that a detailed description of a related known configuration or function interferes with the understanding of the embodiment of the present disclosure, the detailed description thereof will be omitted.

In addition, in describing the components of the embodiment of the present disclosure, terms such as first, second, A, B, (a), (b), etc. may be used. These terms are only used to distinguish the component from other components, and the essence or order of the component is not limited by the term. It should be understood that when a component is described as being "connected", "coupled", or "linked" to another component, that component may be directly connected to or linked to that other component, but yet another component may be "connected", "coupled", or "linked" between each component.

Figure 2:
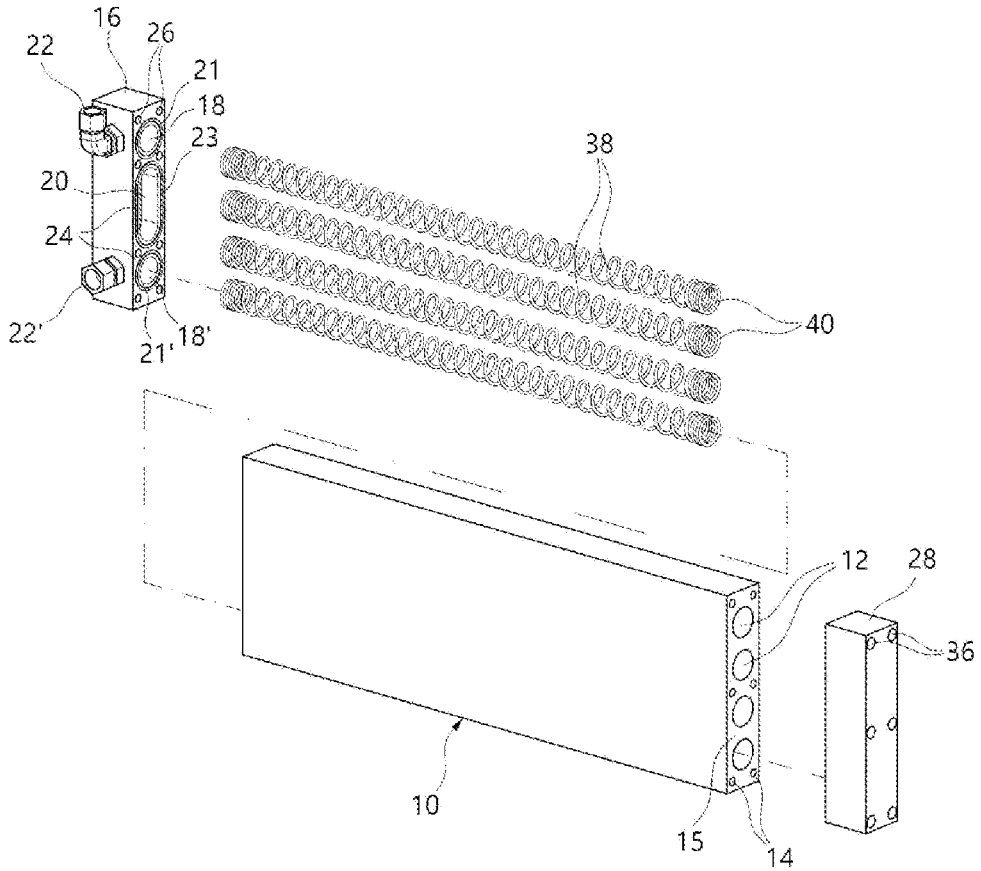
FIG. 2 is an exploded perspective view showing the configuration of the heat dissipating device using turbulent flow according to the embodiment of the present disclosure.
Figure 3:
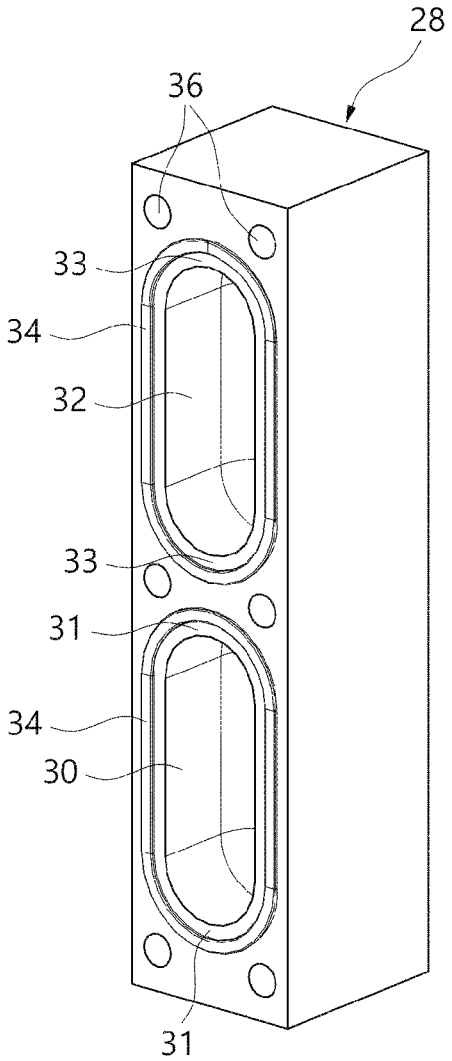
FIG. 3 is a perspective view showing the inner surface of the second cap constituting the heat dissipating device using turbulent flow according to the embodiment of the present disclosure.
Figure 4:
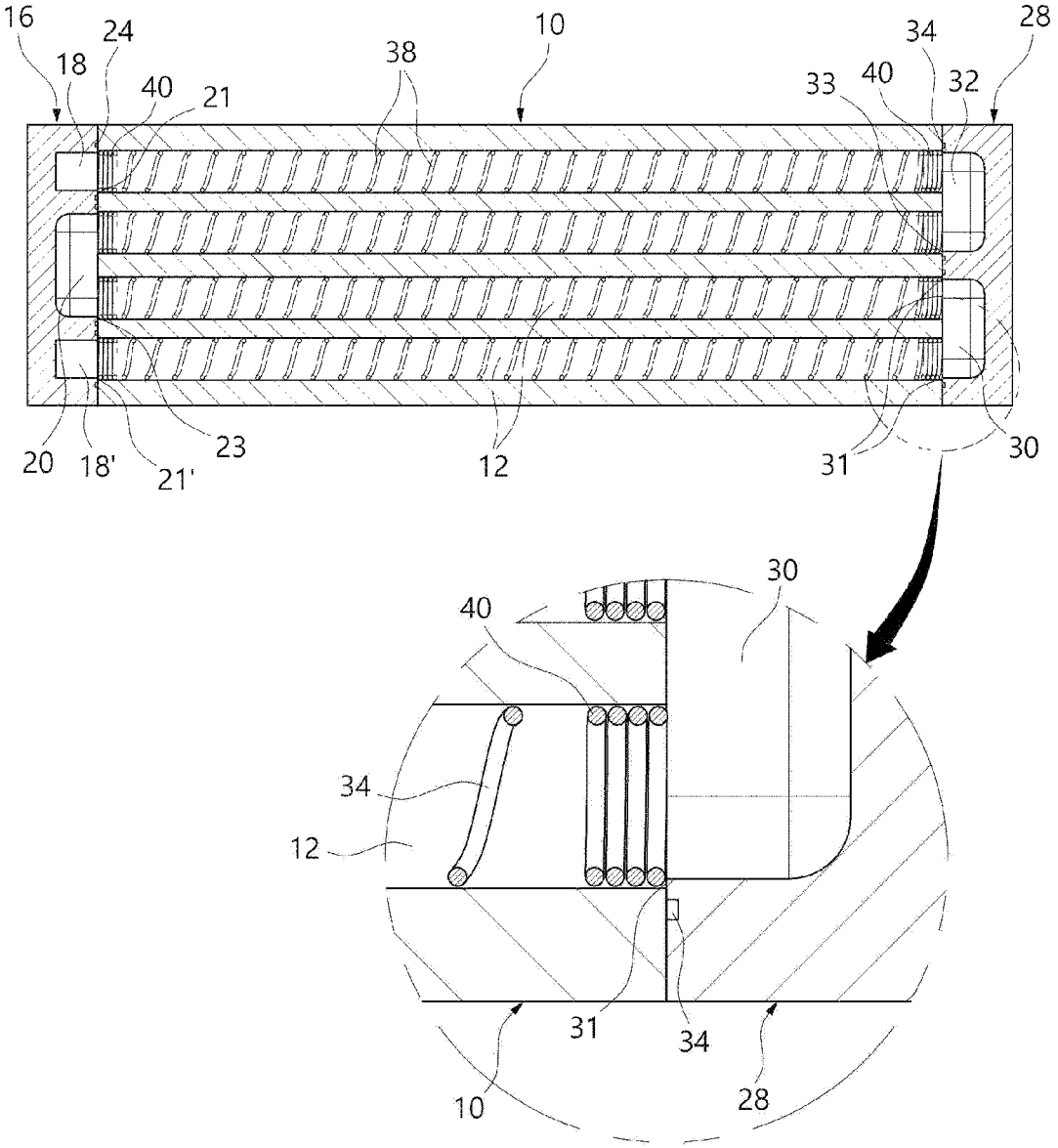
FIG. 4 is a cross-sectional view showing the configuration of the heat dissipating device using turbulent flow according to the embodiment of the present disclosure.
Figure 5:
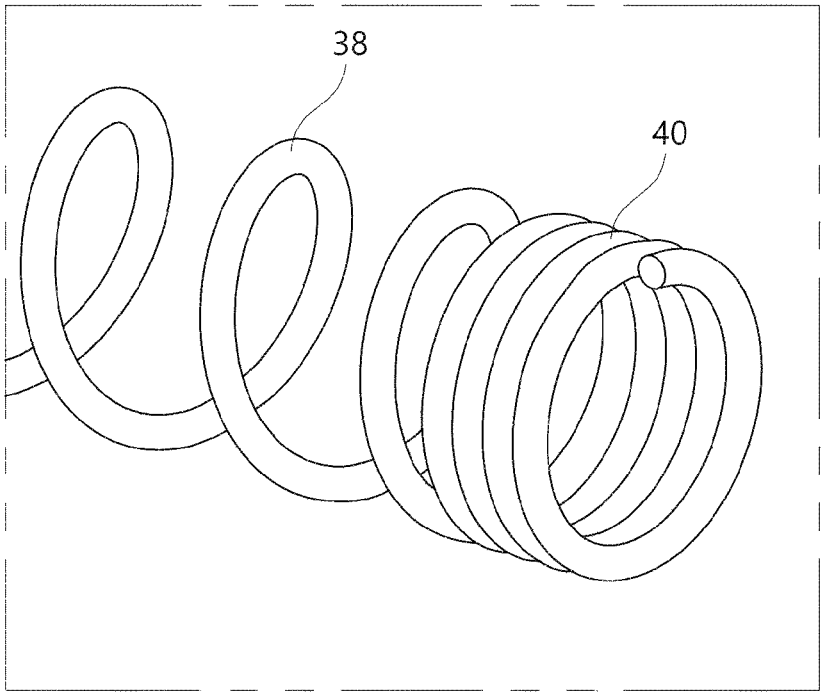
FIG. 5 is a perspective view showing finishing end portions at the ends of a turbulence generator constituting the heat dissipating device using turbulent flow according to the embodiment of the present disclosure.
Figure 6:
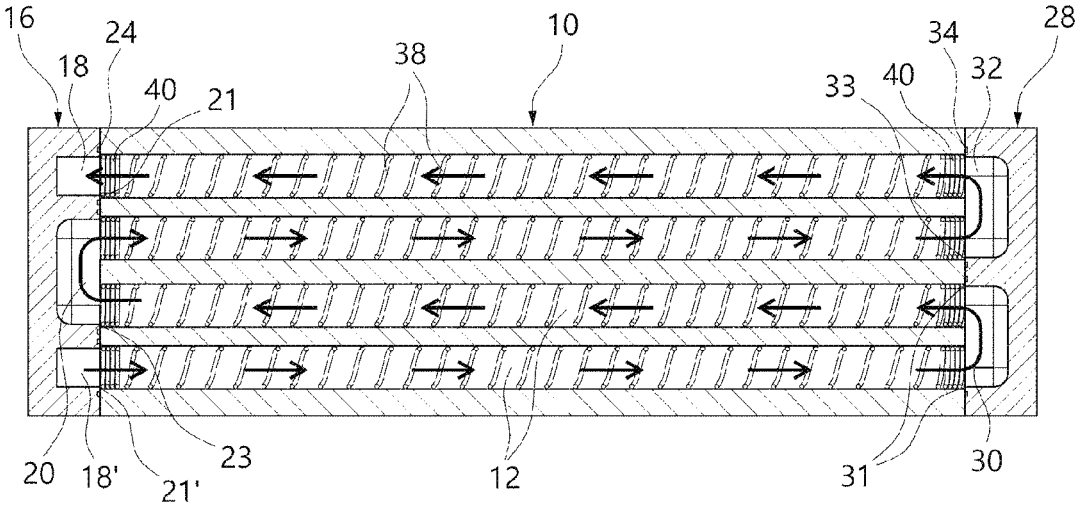
FIG. 6 is an operation state diagram showing a working fluid flowing inside the heat dissipating device using turbulent flow according to the embodiment of the present disclosure.

According to the drawings, a block body 10 forms the exterior and skeleton of the heat dissipating device. The block body 10 has a flat hexahedron shape and the heat source is in close contact with one of the widest outer surfaces thereof. Block flow paths 12 are formed inside the block body 10. In the embodiment, four block flow paths 12 are formed side by side across the inside of the block body 10, as shown in FIG. 2 or 4. The block flow paths 12 are formed in a straight line, a curved line, etc. inside the block body 10 of a flat hexahedron shape.

Body fastening holes 14 are formed in the side surfaces 15 of the block body 10 corresponding to both ends in the longitudinal direction of the block flow path 12. The body fastening holes 14 are a part to which a fastener (not shown) for fastening the first and second caps 16 and 28 to be described below is fastened.

The first cap 16 is fastened to one end side surface 15 of the block body 10. The first cap 16 has inlet/outlet flow paths 18 and 18' and a first connection flow path 20. The first cap 16 is a quadrangular prism-shaped hexahedron, and the inlet/outlet flow paths 18 and 18' and a first connection flow path 20 are formed on a surface in contact with the side surface 15. The inlet/outlet flow paths 18 and 18' have a circular cross section at the end opposite to the side surface 15.

The area corresponding to the edge of the inlet/outlet flow paths 18 and 18' is a portion on which the finishing end portion 40 of the turbulence generator 38, which will be described below, is seated, and is referred to as the hanging ends 21 and 21'. On the hanging ends 21 and 21' the finishing end portion 40 of the turbulence generator 38 can be seated since the inner diameters of the inlet/outlet flow paths 18 and 18' are set to be smaller than the inner diameter of the block flow path 12.

One of the inlet/outlet flow paths 18 and 18' acts as an inlet where the working fluid flows into the heat dissipating device while the other one of the inlet/outlet flow paths 18 and 18' acts as an outlet where the working fluid is discharged from the heat dissipating device. Inlet/outlet connection pipes 22 and 22' are installed in these inlet/outlet flow paths 18 and 18', respectively. Pipes for the flow of the working fluid are coupled to the inlet/outlet connection pipes 22 and 22'.

A first connection flow path 20 is formed on a side surface of the first cap 16 that corresponds a space between the inlet/outlet flow paths 18 and 18'. The first connection flow path 20 serves to communicate two block flow paths 12 formed in the block body 10. The first connection flow path 20 has an elliptical shape when viewed from the front. The region corresponding to the edge of the first connection flow path 20 is a portion where the finishing end portion 40 of the turbulence generator 38 is seated, and this region is also referred to as a hanging end 23. Semi-circular edge regions of both ends of the first connection flow path 20 in the long axis direction become the hanging end 23 of the first connection flow path 20. The inner surface of the first connection flow path 20 has a curved surface as shown in FIG. 4. The inner surface of the first connection flow path 20 is overall curved, especially along the flowing path of the working fluid, making the flow of the working fluid in the first connection flow path 20 smoother.

Seal 24 are installed around the edges of the inlet/outlet flow paths 18 and 18' and the first connection flow path 20, respectively. The seals 24 are seated in seal grooves (reference numeral not assigned) formed at positions corresponding to the edges of the inlet/outlet flow paths 18 and 18' and the first connection flow path 20. The shape of the seal groove is the same as that of the seal 24, and the cross section is made in a quadrangle so that the seal 24 partially sticks out. The seal 24 prevents leakage of the working fluid between the block body 10 and the first cap 16.

Reference numeral 26 denotes cap fastening holes 26 to which fasteners (not shown) are fastened for fastening the first cap 16 to the block body 10.

The second cap 28 is mounted on the opposite side to which the first cap 16 is mounted among the side surfaces 15 of the block body. The second cap 28 is also a quadrangular prism-shaped hexahedron, and the second and third connection flow paths 30 and 32 are formed on a surface in contact with the side surface 15. The second connection flow path 30 is to communicate two block flow paths 12 at a relatively lower portion of the block flow paths 12 of the block body 10 shown in FIG. 2. The third connection flow path 32 is to communicate two block flow paths 12 at a relatively upper portion of the block flow paths 12 of the block body 10.

The inner surfaces of the second connection flow path 30 and the third connection flow path 32 are curved as shown in FIG. 4. The inner surfaces of the second and third connection flow paths 30 and 32 are overall curved, especially along the flowing path of the working fluid, making the flow of the working fluid in the second and third connection flow paths 30 and 32 smoother.

A hanging end 31 is formed on the edge of the second connection flow path 30, and a hanging end 33 is formed on the edge of the third connection flow path 32. The finishing end portions 40 of the turbulence generator 38 are hung on the hanging ends 31 and 33. The hanging ends 31 and 33 are made by forming the diameter of one end of the second connection flow path 30 smaller than the diameter of the block flow path 12.

Seals 34 are installed around the edges of the second connection flow path 30 and the third connection flow path 32. The shape of the seal 34 corresponds to the front shape of the second connection flow path 30 and the third connection flow path 32, and is made slightly larger. In the embodiment, the seal 34 is made in an elliptical shape. These seals 34 are seated in the seal grooves (reference numerals not assigned) to be installed firmly.

On the side of the second cap 28 that is in close contact with the side surface 15 of the block body 10, cap fastening holes 36 for fastening with the block body 10 are formed in positions correspond to the body fastening holes 14. Through the cap fastening holes 36, fasteners are fastened to the body fastening holes 14.

The turbulence generator 38 located in the block flow path 12 of the block body 10 has the outer diameter approximately equal to the inner diameter of the block flow path 12. The turbulence generator 38 is made in the shape of a cylindrical coil spring. The turbulence generator 38 causes the working fluid flowing in the block flow paths 12 to flow in a turbulent flow. The finishing end portions 40 are formed at both ends 40 of the turbulence generator 38. The finishing end portion 40 is made in a ring shape.

The finishing end portion 40 is such that a number of turns of the ring-shaped portion forming the cylindrical coil spring is more than two. When the finishing end portion 40 is made to have a plurality of turns in this way, both ends of the turbulence generator 38 are made firmly and the ends of the turbulence generator 38 can be more firmly supported by the hanging ends 21, 21', 23, 31, and 33.

Hereinafter, the assembly and use of the heat dissipating device using turbulent flow according to the present disclosure having the configuration as described above will be described in detail.

One turbulence generator 38 is inserted into one block flow path 12 of the block body 10. In the state in which the turbulence generators 38 are inserted into the block flow path 12, the first cap 16 is mounted and fastened to one end side surface 15 of both ends of the block body 10, and the second cap 28 is mounted and fastened to the other end side surface 15.

The first cap 16 and the second cap 28 are fastened to the end side surfaces 15 by the fasteners passing through the cap fastening holes 26 and 36 and being fastened to the body fastening holes 14. In this process, the seals 24 and 34 are in close contact between the first cap 16 and the side surface 15 of the block body 10, and between the second cap 28 and the side surface 15 of the block body 10 to perform a sealing action.

Then, the finishing end portions 40 of the turbulence generators 38 in the block flow paths 12 are hung on the respective hanging ends 21, 21', 23, 31, and 33. This is possible because the diameter of the finishing end portion 40 is the same as the diameter of each region forming the respective hanging ends 21, 21', 23, 31, and 33. This is possible especially because the diameter of each region forming the respective hanging ends 21, 21', 23, 31, and 33 is smaller than the diameter of the block flow path 12.

As described above, the finishing end portions 40 of the turbulence generators 38 are hung on the hanging ends 21, 21', 23, 31, and 33 so that the turbulence generators 38 may be firmly supported in the block flow paths 12. In particular, the turbulence generators 38 are elastically deformed by the hanging ends 21, 21', 23, 31, and 33 and are located in the block flow paths 12 in a slightly compressed state. As the turbulence generators 38 are installed in the block flow paths 12 in such a structure, the turbulence generators 38 are firmly positioned in the block flow paths 12, and thereby the flow of the working fluid becomes turbulent.

Meanwhile, the inner surfaces of the first connection flow path 20, the second connection flow path 30, and the third connection flow path 32 are curved so that the path of the working fluid is curved. Therefore, the flow of the working fluid in the portions connecting the block flow paths 12 is smoother and no flow loss occurs.

In the case of the heat dissipating device of the present disclosure, if the inlet/outlet connection pipe 22' is an inlet, for example, the working fluid enters the inlet/outlet flow path 18' and flows along the block flow path 12 located at the lowermost end (in the drawing) of the block body 10. At the end of the lowermost block flow path 12, the working fluid flows through the second connection flow path 30 to the next block flow path 12 and at the end of this block flow path 12, flows through the first connection flow path 20 to the next block flow path 12. Again, at the end of this block flow path 12, the working fluid passes through the third connection flow path 32, and flows along the block flow path 12 at the uppermost end (in the drawing) of the block body 10 then flows to the inlet/outlet connection pipe 22.

In the process of the working fluid flowing in this way, the flow of the working fluid becomes turbulent by the turbulence generators 38 in the block flow paths 12, and the working fluid is better able to transfer the heat from the heat source. The working fluid that receives the heat from the heat source passes through the inlet/outlet connection pipe 22 and transfers heat from a heat exchange unit for heat exchange with the atmosphere to the atmosphere, and the temperature of the working fluid is lowered. Then, the working fluid with lower temperature again enters the heat dissipating device of the present disclosure through the inlet/outlet connection pipe 22' and receives heat from the heat source, and the process described above is repeated.

In the above, even though it has been described that all components constituting the embodiment of the present disclosure operate by being combined or combined into one, the present disclosure is not necessarily limited to this embodiment. That is, within the scope of the objectives of the present disclosure, all of the components may operate by selectively combining one or more. In addition, since terms such as "include", "comprise", or "have" described above mean that the corresponding component may be inherent unless otherwise defined, it should not be construed as excluding other components, but may further include other components. All terms used herein, including technical or scientific terms, have the same meaning as commonly understood by a person skilled in the art. Terms such as those defined in the commonly used dictionaries should be construed as having meanings consistent with the meanings in the context of the related art and shall not be construed in ideal or excessively formal meanings unless expressly defined in the present disclosure.

The above description is merely illustrative of the technical idea of the present disclosure, and a person skilled in the art to which the present disclosure pertains may implement various modifications and variations without departing from the gist of the present disclosure. Accordingly, the embodiment disclosed in the present disclosure is not intended to limit, but to illustrate the technical spirit of the present disclosure, thus the scope of the technical idea of the present disclosure is not limited by the embodiment. The protection scope of the present disclosure should be interpreted by the appended claims and all technical ideas within the scope equivalent thereto should be construed as being included in the scope of the present disclosure.

In the illustrated embodiment, the hanging ends 21, 21', 23, 31, and 33 are continuously formed at the edges of the inlet/outlet flow paths 18 and 18' and the connection flow paths 20, 30, and 32 respectively, but this is not necessarily the case and may be formed so that the finishing end portions 40 of the turbulence generator 38 can be supported. For example, the hanging ends 21, 21', 23, 31, and 33 may be formed intermittently, instead of being formed continuously.

Also, in the illustrated embodiment, the number of block flow paths 12 is four, but the number of block flow paths 12 may be increased or decreased depending on design conditions. For example, the first cap 16 may have only the inlet/outlet flow paths 18 and 18' without the connection flow path 20, and the second cap 28 may have only one connection flow path. This is the case with two block flow paths 12.

If there are three block flow paths 12, there is an inlet on one side of the block body 10 and an outlet on the other side, and in this case, the first cap 16 has one inlet/outlet flow path 18 and one connection flow path, and the second cap 28 has one inlet/outlet flow path 18' and one connection flow path.

In the case of five block flow paths 12, the first cap 16 has one inlet/outlet flow path 18 and two connection flow paths, and the second cap 28 also has one inlet/outlet flow path 18' and two connection flow paths.

In the illustrated embodiment the seals 24 and 34 were positioned in the seal grooves formed in the first cap 16 and the second cap 28, but the seals may be located in the seal groove formed on the end side surface 15 of the block body 10.

The invention claimed is:

1. A heat dissipating device using turbulent flow, the device comprising:

a block body in which a plurality of block flow paths through which a working fluid flows are formed side by side;

a first cap coupled to a side surface formed at a first end of the block body, and in which a connection flow path connecting between the block flow paths is formed;

a second cap coupled to a side surface formed at a second end of the block body, and in which connection flow path connecting between the block flow paths is formed; and a turbulence generator installed inside the block flow paths to make a flow of the working fluid turbulent, with finishing end portions formed at opposite ends thereof being supported by the first cap and the second cap.

2. The heat dissipating device using turbulent flow of claim 1, wherein the first cap and the second cap are provided with inlet/outlet flow paths through which the working fluid enters and exits the block flow paths.

3. The heat dissipating device using turbulent flow of claim 2, wherein hanging ends at which the finishing end portions of the turbulence generator are supported by the first cap and the second cap function as edge regions of the inlet/outlet flow paths and the connection flow path formed in the first cap, and of the inlet/outlet flow paths and the connection flow paths formed in the second cap.

4. The heat dissipating device using turbulent flow of claim 3, wherein the turbulence generator has a cylindrical coil spring shape and has an outer diameter smaller than an inner diameter of each of the block flow paths, and an outer diameter of each of the finishing end portions of the turbulence generator is formed to be larger than a diameter of a circular region in which the hanging ends are formed.

5. The heat dissipating device using turbulent flow of claim 4, wherein a number of turns of the cylindrical coil spring formed at each of the finishing end portions is more than two.

6. The heat dissipating device using turbulent flow of claim 2, wherein the inlet/outlet flow paths are connected to inlet/outlet connection pipes.

7. The heat dissipating device using turbulent flow of claim 1, wherein each of the connection flow path formed in the first cap and the connection flow paths formed in the second cap has a curved inner surface.

8. The heat dissipating device using turbulent flow of claim 1, wherein a seal is positioned between the first cap and the side surface of the block body or the second cap and the side surface of the block body, a seal groove in which the seal is located is formed on either side of the first cap or the side surface of the block body, or on either side of the second cap or the side surface of the block body.

* * * * *